US008376249B2

(12) United States Patent
Huang

(10) Patent No.: US 8,376,249 B2
(45) Date of Patent: Feb. 19, 2013

(54) MOVABLE STRUCTURE OF FAUCET OUTLET

(75) Inventor: Li-Chen Huang, Changhua (TW)

(73) Assignee: Alexander Yeh Industry Co. Ltd., Changhua (TW)

( * ) Notice: Subject to any disclaimer, the term of this patent is extended or adjusted under 35 U.S.C. 154(b) by 146 days.

(21) Appl. No.: 13/099,746

(22) Filed: May 3, 2011

(65) Prior Publication Data

US 2012/0280068 A1 Nov. 8, 2012

(51) Int. Cl.
*B05B 15/08* (2006.01)

(52) U.S. Cl. ..... 239/587.5; 239/505; 239/513; 239/548; 239/566; 239/587.1; 239/587.6; 239/586; 239/569; 4/678; 251/319; 251/339; 137/801

(58) Field of Classification Search ..... 239/505, 239/513, 548, 552, 566, 569, 583, 586, 587.1, 239/587.5, 587.6, 597, 598; 4/675, 678; 251/319, 339; 137/801
See application file for complete search history.

(56) References Cited

U.S. PATENT DOCUMENTS

| | | | | |
|---|---|---|---|---|
| 1,345,803 | A * | 7/1920 | Muntz | 239/569 |
| 3,801,997 | A * | 4/1974 | Ward | 4/678 |
| 5,687,952 | A * | 11/1997 | Arnold et al. | 239/583 |
| 6,070,280 | A * | 6/2000 | Ko | 137/801 |
| 6,301,727 | B1 * | 10/2001 | Bertrand et al. | 4/678 |
| 6,449,784 | B1 * | 9/2002 | Pelletz | 137/801 |
| 6,925,662 | B1 * | 8/2005 | Tan et al. | 4/678 |

* cited by examiner

*Primary Examiner* — Steven J Ganey
(74) *Attorney, Agent, or Firm* — Che-Yang Chen; Law Office of Michael Chen

(57) ABSTRACT

A movable structure of a faucet outlet including a faucet body, a connecting tube, a switching valve stick, a valve unit, a water outlet head and a cover, wherein the faucet body has a water channel in front of an inner space therein and a water outlet with a downward opening. A converging space at the faucet body has a board and a positioning hole. The water outlet head is an elongated and hollow body where a plurality of separation boards are formed to generate a plurality of water outlet channels, and a connecting point is formed at each lateral side of the water outlet channel. The other side of the cover has a sealing surface next to the water channel to securely cover on the water outlet of the cover, and a water-stopping ring is located between the water outlet and the cover.

7 Claims, 6 Drawing Sheets

MOVABLE STRUCTURE OF FAUCET OUTLET

FIELD OF THE INVENTION

The present invention is related to a swinging structure of a faucet outlet, and more specifically to a faucet outlet structure in which an angle of water flow can be adjusted to avoid overly strong water spray.

BACKGROUND OF THE INVENTION

Some faucets with dual functions for shower and bathtub have two ways to output water. One way is to provide a significant amount of water directly from the bathtub, which can be used for people taking a bath in the bathtub. The other is to externally connect a pipe to a shower head so that the water can be output from a higher location and the user can use it for taking a shower. These two different ways of water output can be switched by a switch valve to switch the source of water. In other words, when the faucet is switched on, the water directly flows into the bathtub from a front end of the faucet. If the user wants to change the way of water output, he/she can pull the switch valve upward to shut off the water channel in the front of the faucet, so that the water can be provided from the pipe connected to the shower head. Meanwhile, the switch valve (pulled up) can be supported by the water pressure to avoid falling down. The water pressure can be removed and the switch valve of the faucet can be restored when the water is no longer provided by the water source, or the pressure provided by the user is stronger than the water pressure.

However, when the water directly flows out from the front portion of the faucet, the water can only flow at one fixed angle and cannot be adjusted, so it is not flexible enough when in use and it is likely to have dead angle that can not be reached. More importantly, when the water flows out directly without buffering, the water spray may be too strong to splash the floor nearby which may cause people walking by to slip and fall, and the floor in the bathroom cannot keep dry.

Therefore, there remains a need for a new and improved faucet outlet structure that provides a water buffer to avoid strong water spray and a adjustable water outlet head to eliminate dead angle.

SUMMARY OF THE INVENTION

The technical problem to be solved in the present invention is that the water outlet angle cannot be adjusted and when water flows out directly, the water spray may be too strong to splash the floor nearby.

The technical point to solve the problem mentioned above is that the present invention provides a movable structure of a faucet outlet including a faucet body, a connecting tube, a switching valve stick, a valve unit, a water outlet head and a cover, wherein the faucet body has an inner space inside and a water channel connecting to the faucet body and in front of the inner space, and the inner space provides a space for the connecting tube to connect with the water channel. A water outlet is formed in a front portion of the faucet body with a downward opening and is connected with the water channel. A converging space is formed on top of the water outlet, a board is formed in the faucet body and on top of the converging space, and a positioning hole which can be penetrated by the switching valve stick. One end of the connecting tube is connected at the water channel of the faucet body and the other end is configured to connect with water pipes hidden in the wall. One end of the switching valve stick is enlarged and formed a pulling head and the other end penetrates in the positioning hole from an outer portion of the faucet head, such that an engaging segment of the end can be engaged and positioned with the valve unit in the converging space. The valve unit has a water separation board and one end of which is protruding to form a trough space having an anti-leaking pad, and the other end has a two-prong clutch to engage with the engaging segment after the valve unit is put into the water outlet, such that the valve unit can be engaged and moved with the switching valve stick. The water outlet head is an elongated and hollow body where a plurality of separation boards are formed to generate a plurality of water outlet channels, and a stopping edge is formed circularly above the water outlet channels. Also, a connecting point is formed at each lateral side of the water outlet channel. One side of the cover has an elongated opening and a longer side of which has a protruding unit, and a positioning slot is formed at each shorter sides, wherein the elongated opening provides a space for the water outlet head that is fixed at the positioning slot with the connecting point to securely position the water outlet head. The other side of the cover has a sealing surface next to the water channel to securely cover on the water outlet of the faucet body, and a water-stopping ring is located between the water outlet and the cover.

Comparing with conventional techniques, the faucet outlet structure in the present invention has the following advantages. First, the water is accumulated in the converging space. When the level of the accumulated water is higher than the protruding unit and the stopping edge and flows out from the water outlet channels, it can achieve the goal of buffering so as to avoid overly strong water spray to splash on the surrounding floor and further prevent people walking by from slipping and falling.

Second, when the water flows out, the output angle can be changed by rotating the water outlet head according to the user's habit and preference, so that it is more flexible for the user to use and there is no dead angle when the angle can be adjusted.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications which might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
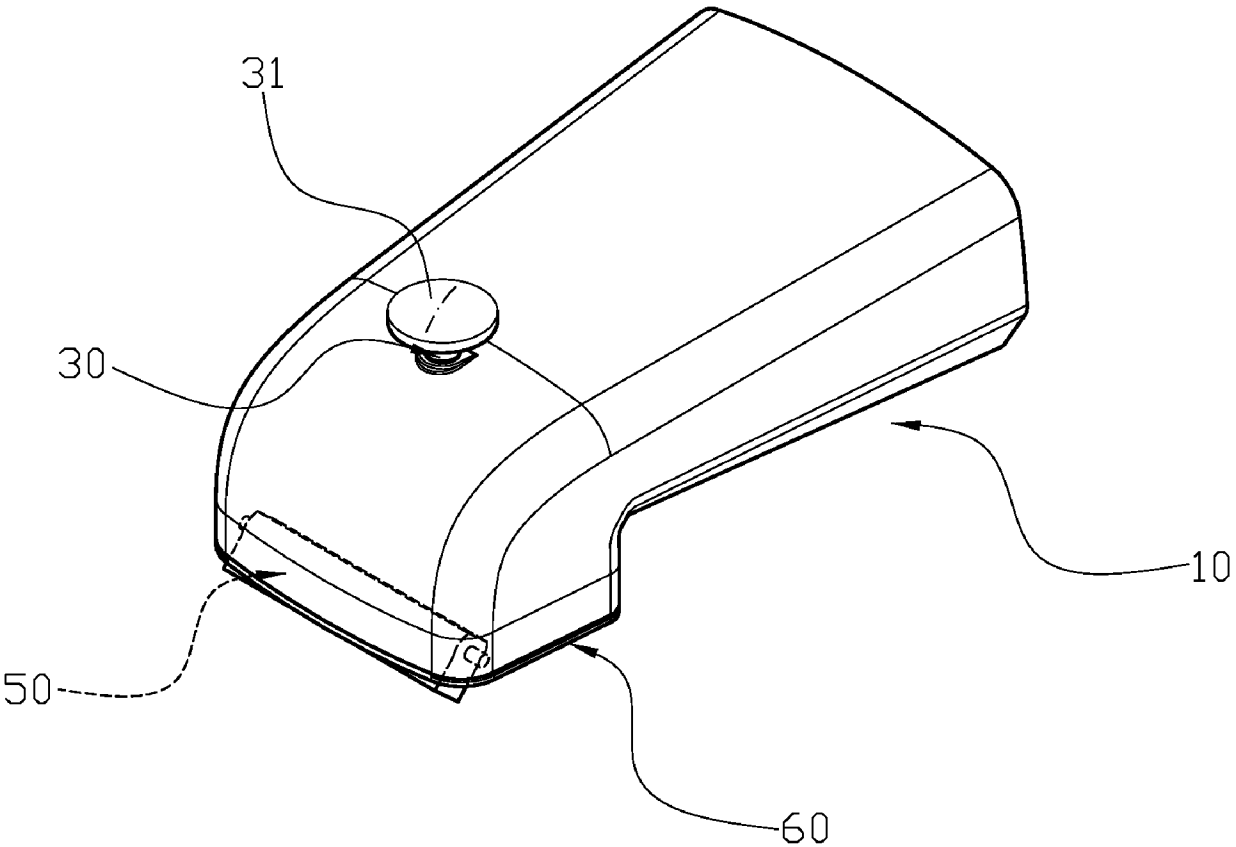
FIG. 1 illustrates a three-dimensional assembled view in the present invention.
Figure 2:
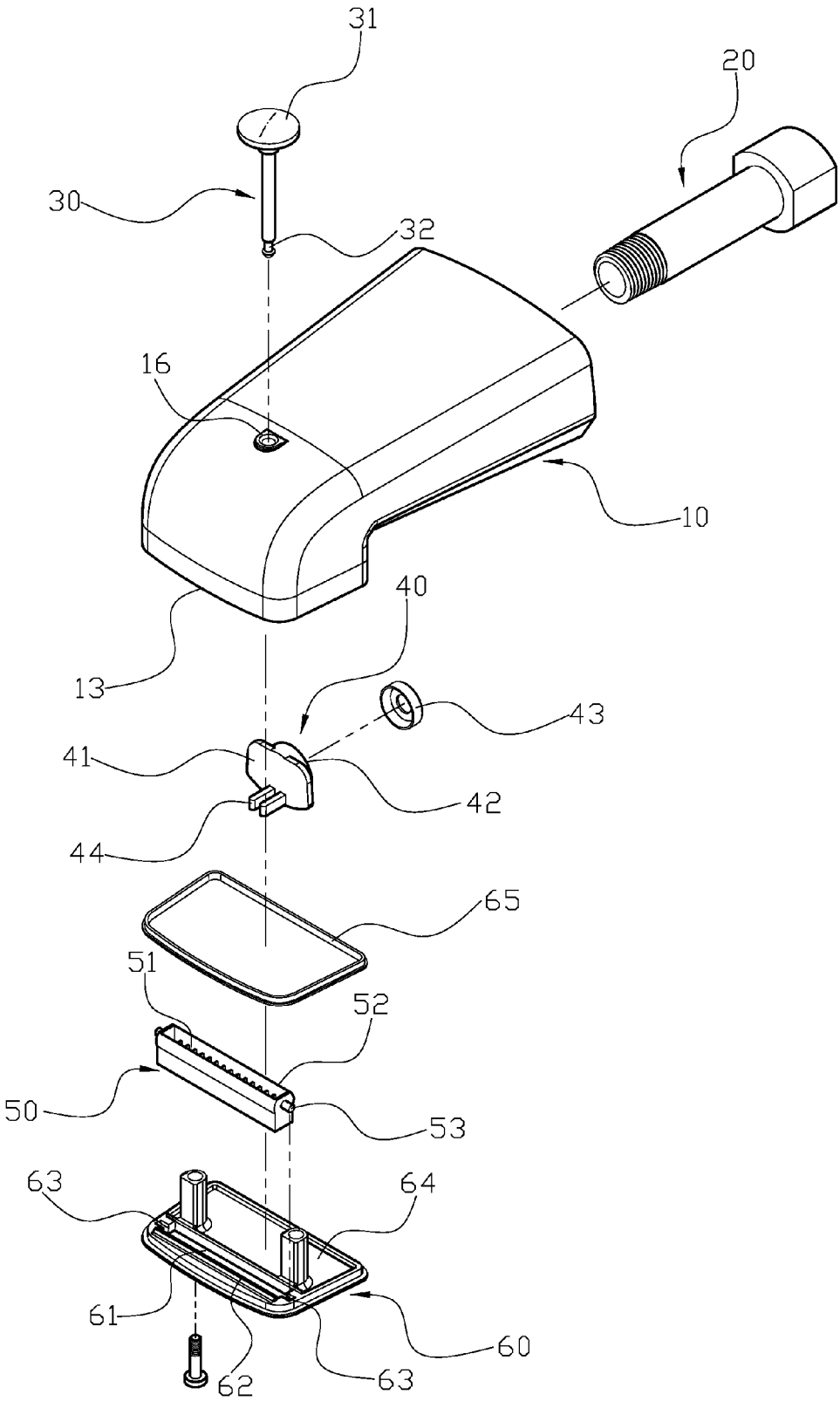
FIG. 2 illustrates a three-dimensional exploded view in the present invention.
Figure 3:
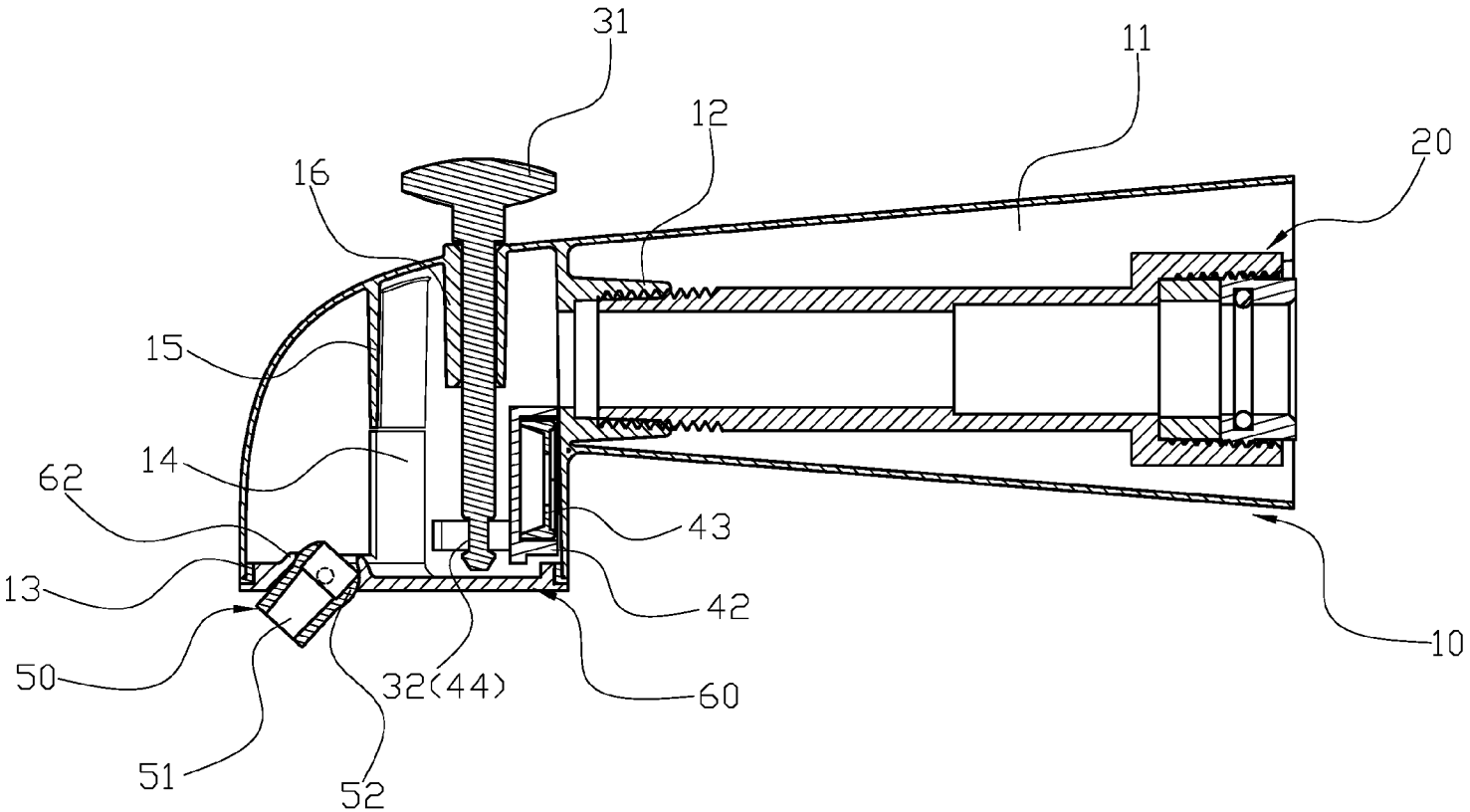
FIG. 3 illustrates a sectional assembled view in the present invention.

In order to further understand the goal, characteristics and effect of the present invention, a number of embodiments along with the drawings are illustrated as following:

Referring to FIGS. 1 to 3, the present invention includes a faucet body (10), a connecting tube (20), a switching valve stick (30), a valve unit (40), a water outlet head (50) and a cover (60), wherein the faucet body (10) has an inner space (11) inside and a water channel (12) connecting to the faucet body (10) and in front of the inner space (11), and the inner space (11) provides a space for the connecting tube (20) to connect with the water channel (12). A water outlet (13) is formed in a front portion of the faucet body (10) with a downward opening and is connected with the water channel (12). A converging space (14) is formed on top of the water outlet (13), a board (15) is formed in the faucet body (10) and on top of the converging space (14), and a positioning hole (16) which can be penetrated by the switching valve stick (30). One end of the connecting tube (20) is connected at the water channel (12) of the faucet body (10) and the other end is configured to connect with water pipes hidden in the wall. One end of the switching valve stick (30) is enlarged and formed a pulling head (31) and the other end penetrates in the positioning hole (16) from an outer portion of the faucet head (10), such that an engaging segment (32) of the end can be engaged and positioned with the valve unit (40) in the converging space (14). The valve unit (40) has a water separation board (41) and one end of which is protruding to form a trough space (42) having a anti-leaking pad (43), and the other end has a two-prong clutch (44) to engage with the engaging segment (32) after the valve unit (40) is put into the water outlet (13), such that the valve unit (40) can be engaged and moved with the switching valve stick (30). The water outlet head (50) is an elongated and hollow body where a plurality of separation boards are formed to generate a plurality of water outlet channels (51), and a stopping edge (52) is formed circularly above the water outlet channels (51). Also, a connecting point (53) is formed at each lateral side of the water outlet channel (51). One side of the cover (60) has an elongated opening (61) and a longer side of which has a protruding unit (62), and a positioning slot (63) is formed at each shorter sides, wherein the elongated opening (61) provides a space for the water outlet head (50) which is fixed at the positioning slot (63) with the connecting point (53) to securely position the water outlet head (50). The other side of the cover (60) has a sealing surface (64) next to the water channel (12) to securely cover on the water outlet (13) of the faucet body (10), and a water-stopping ring (65) is located between the water outlet (13) and the cover (60).

Figure 4:
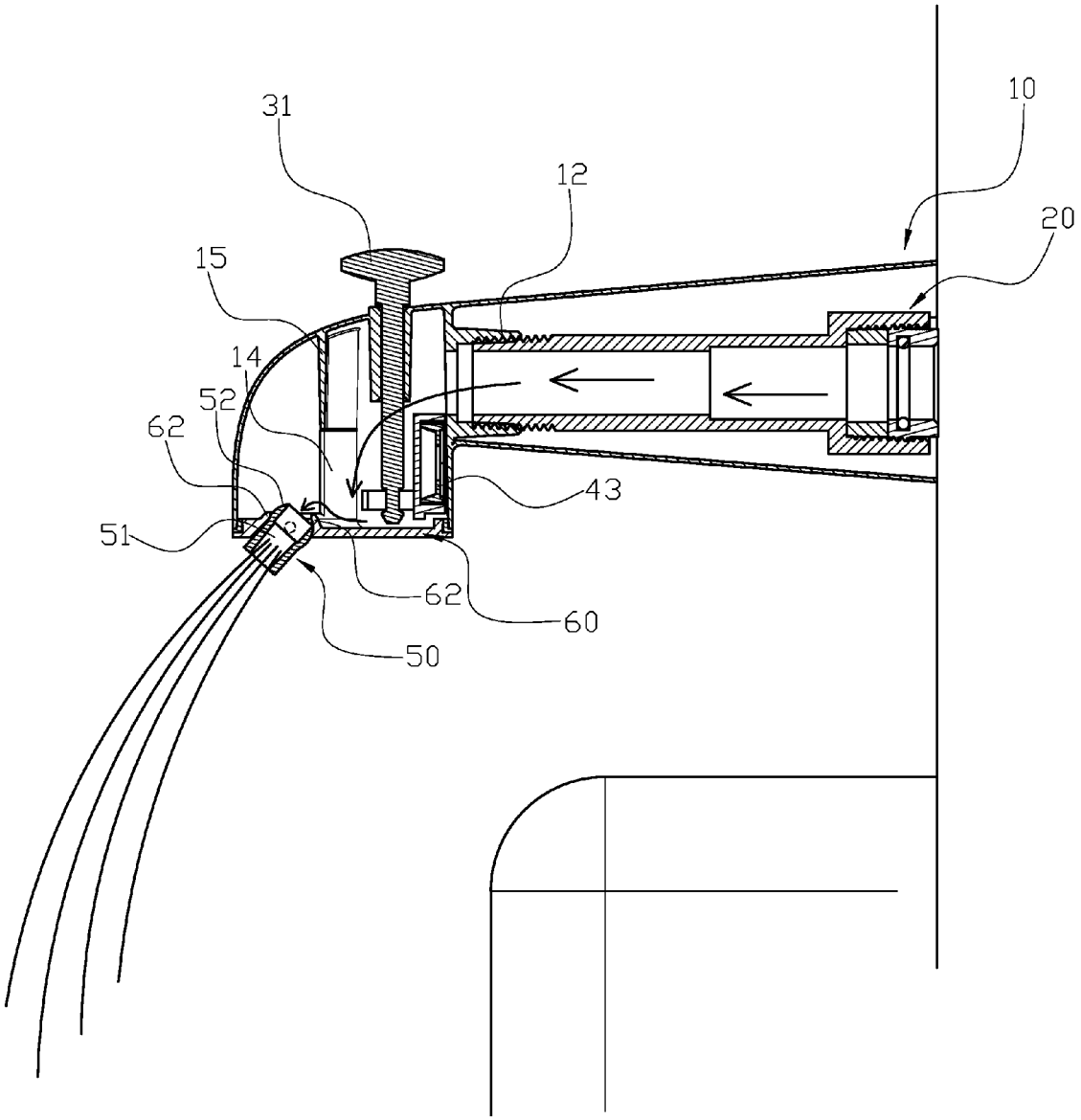
FIG. 4 illustrates a schematic view of water output in the front portion in the present invention.
Figure 5:
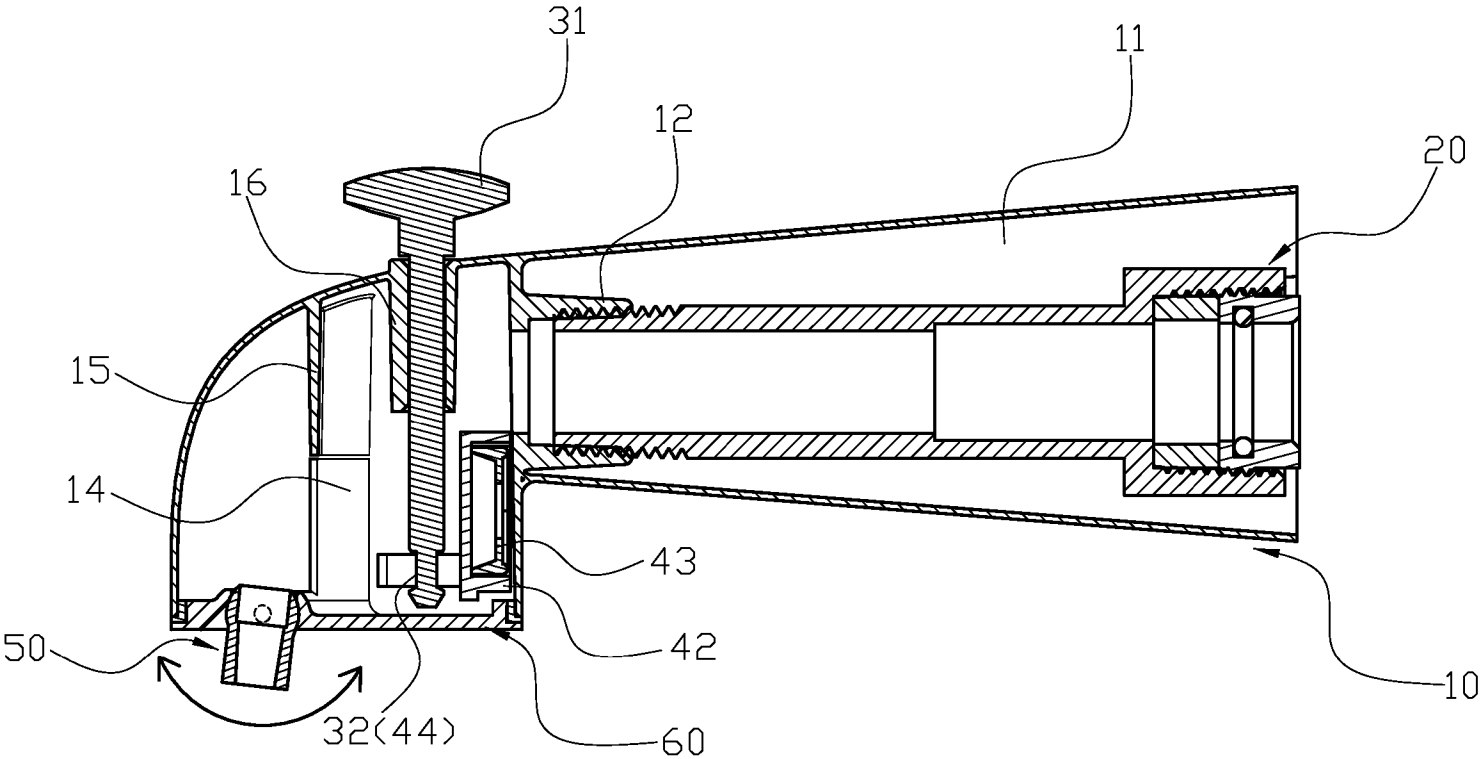
FIG. 5 is a schematic view of adjusting the angle of water output in the front portion in the present invention.
Figure 6:
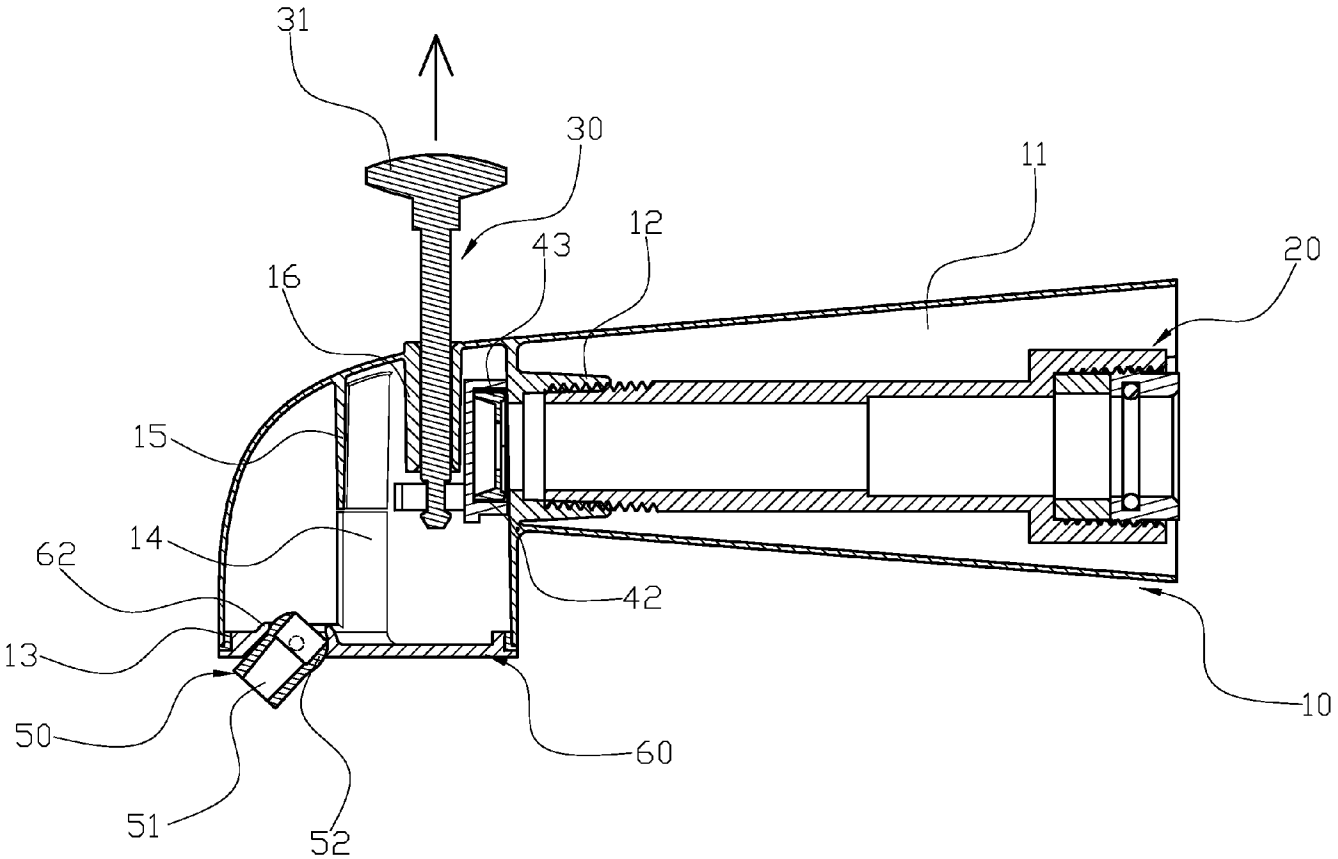
FIG. 6 is a schematic view of pulling the switching valve stick in the present invention.

Practically, if the pulling head (31) is not triggered to move, the water will directly flow through the connecting tube (20) and be stopped by the sealing surface (64) of the cover (60) and accumulated in the converging space (14). When the level of the accumulated water is higher than the protruding unit (62) and the stopping edge (52) and flows out from the water outlet channels (51) (see FIG. 4), it can achieve the goal of buffering so as to avoid overly strong water spray to splash on the surrounding floor. Moreover, when the water flows out, the output angle can be changed (see FIG. 5) by rotating the water outlet head (50) according to the user's habit and preference, so that it is more flexible for the user to use and there is no dead angle when the angle can be adjusted. When the pulling head is pulled up (see FIG. 6), the switching valve stick (30) drives the valve unit (40) to close the channel in the connecting tube (20) by utilizing the water separation board (41), the trough space (42) and the anti-leaking pad (43), so that the water can fill up inside to generate water pressure to prevent the valve unit (40) from falling down. The water can also flow upward to a pipe connected to a shower head so as to spray therefrom. When the pulling head (31) is pushed back or there is no water provided, internal water pressure cannot be accumulated so that the switching valve stick (30) and the valve unit (40) fall down due to gravity and open the connecting tube (20) again. The board (15) can be used as a buffer so the water is less likely to directly spray along a curve to the user from the water outlet head (50).

The faucet outlet structure in the present invention has the following advantages: First, the water is accumulated in the converging space (14). When the level of the accumulated water is higher than the protruding unit (62) and the stopping edge (52) and flows out from the water outlet channels (51), it can achieve the goal of buffering so as to avoid overly strong water spray to splash on the surrounding floor and further prevent people walking by from slipping and falling. Second, when the water flows out, the output angle can be changed by rotating the water outlet head (50) according to the user's habit and preference, so that it is more flexible for the user to use and there is no dead angle when the faucet is in use.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A movable structure of a faucet outlet comprising a faucet body, a connecting tube, a water outlet head and a cover, wherein the faucet body has an inner space inside and a water channel in front of the inner space connecting to the faucet body, and the inner space provides a space for the connecting tube to connect with the water channel, and a water outlet is formed in a front portion of the faucet body with a downward opening and is connected with the water channel, and a converging space is formed on top of the water outlet, wherein one end of the connecting tube is connected at the water channel of the faucet body and the other end is configured to connect with water pipes hidden in the wall, wherein the water outlet head is an elongated and hollow body where a plurality of water outlet channels are formed, and a connecting point is formed at each lateral side of the water outlet head, wherein one side of the cover has an elongated opening and a longer side of which has a protruding unit, while a shallow positioning slot is formed at each shorter sides, wherein the elongated opening provides a space for the water outlet head that is fixed at the positioning slot with the connecting point to securely position the water outlet head, and other side of the cover has a sealing surface next to the water channel to securely cover on the water outlet of the faucet body, and wherein the water directly flows through the connecting tube, and is stopped by the sealing surface of the cover and accumulated in the converging space, and when the level of the accumulated water is higher than the protruding unit, and then flows out from the water outlet channels, it is buffered to avoid overly strong water spray to splash on the surrounding floor, and when the water flows out, an output angle is adjusted by rotating the water outlet head according to the user's habit and preference, so that it is more flexible for the user to use and there is no dead angle when the faucet is in use.

2. The movable structure of a faucet outlet of claim 1, wherein a board is formed in the faucet body and on top of the converging space.

3. The movable structure of a faucet outlet of claim 1, wherein a positioning hole formed on top of the converging space in the faucet body is penetrated by the switching valve stick to drive the valve unit.

4. The movable structure of a faucet outlet of claim 1, wherein one end of the switching valve stick is enlarged to form a pulling head and the other end penetrates in the positioning hole, such that an engaging segment of the end is engaged and positioned with the valve unit in the faucet body, and the valve unit has a water separation board and one end of which is protruding to form a trough space having an anti-leaking pad, and the other end thereof has a two-prong clutch to engage with the engaging segment after the valve unit is positioned, such that the valve unit is engaged and moved with the switching valve stick.

5. The movable structure of a faucet outlet of claim 1, wherein the water outlet head is an elongated and hollow body where a plurality of separation boards are formed to generate the plurality of water outlet channels.

6. The movable structure of a faucet outlet of claim 1, wherein a stopping edge is formed circularly above the water outlet channels.

7. The movable structure of a faucet outlet of claim 1, wherein a water-stopping ring is located between the water outlet and the cover.

* * * * *